US009416546B2

(12) United States Patent
Claudin

(10) Patent No.: US 9,416,546 B2
(45) Date of Patent: Aug. 16, 2016

(54) DECK INSTALLATION TRACK AND METHOD

(71) Applicant: Mark Claudin, Lakewood, CO (US)

(72) Inventor: Mark Claudin, Lakewood, CO (US)

(73) Assignee: Mark Claudin, Lakewood, CO (US)

( * ) Notice: Subject to any disclaimer, the term of this patent is extended or adjusted under 35 U.S.C. 154(b) by 0 days.

(21) Appl. No.: 14/480,172

(22) Filed: Sep. 8, 2014

(65) Prior Publication Data

US 2015/0075111 A1 Mar. 19, 2015

Related U.S. Application Data

(63) Continuation-in-part of application No. 29/411,646, filed on Jan. 24, 2012, now abandoned.

(51) Int. Cl.

| | |
|---|---|
| ***E04F 15/16*** | (2006.01) |
| ***E04F 15/04*** | (2006.01) |
| ***E04F 15/02*** | (2006.01) |
| *E04B 5/43* | (2006.01) |
| *E04B 2/30* | (2006.01) |

(52) U.S. Cl.

CPC ..... *E04F 15/02044* (2013.01); *E04F 15/02022* (2013.01); *E04F 15/02183* (2013.01); *E04B 2/30* (2013.01); *E04B 5/43* (2013.01); *E04F 2015/02094* (2013.01)

(58) Field of Classification Search

CPC ..... E04F 2011/1047; E04F 2201/0535; E04F 211/108; E04F 15/04; E04F 15/16; E04F 21/20; E04F 15/02044; E04F 15/02022; E04F 15/02183; E04B 1/40; E04B 5/43; E04B 2/30; E04B 2/08

USPC ..... 52/489.1, 177, 480, 586.1, 512, 650.3, 52/384, 385

See application file for complete search history.

(56) References Cited

U.S. PATENT DOCUMENTS

| | | | | |
|---|---|---|---|---|
| 5,617,689 | A * | 4/1997 | Beane | 52/489.1 |
| 5,881,508 | A * | 3/1999 | Irvine et al. | 52/177 |
| 5,950,377 | A * | 9/1999 | Yoder | 52/177 |
| 6,112,479 | A * | 9/2000 | Andres | 52/177 |
| 6,233,886 | B1 * | 5/2001 | Andres | 52/177 |
| 6,301,842 | B1 * | 10/2001 | Chaney et al. | 52/177 |
| 6,339,908 | B1 * | 1/2002 | Chuang | 52/589.1 |
| D462,601 | S * | 9/2002 | Chaney | D8/354 |
| 8,146,303 | B2 * | 4/2012 | Gibson et al. | 52/177 |
| 2002/0056238 | A1 * | 5/2002 | Leines | 52/177 |
| 2009/0071089 | A1 * | 3/2009 | Neuhofer, Jr. | 52/469 |
| 2010/0024326 | A1 * | 2/2010 | Turner et al. | 52/177 |

* cited by examiner

*Primary Examiner* — Phi A

(74) *Attorney, Agent, or Firm* — Neugeboren O'Dowd PC

(57) ABSTRACT

A system and method for installing decking are described. One embodiment includes a method of installing decking. The method includes aligning a track for decking relative to a joist. The method further includes attaching the track to the joist, and snapping a decking board into a retaining portion of the track after attaching. In the system, the track has a base element with at least one attachment element for attaching the track to a joist, a first snap-fit element, and a second snap-fit element. The first snap-fit element is coupled to a first end portion of the base element, and the second snap-fit element is coupled to a second end portion of the base element. The snap-fit elements are configured to retain at least one decking board.

10 Claims, 10 Drawing Sheets

DECK INSTALLATION TRACK AND METHOD

PRIORITY

The present application claims priority from, and is a continuation-in-part of, U.S. patent application Ser. No. 29/411,646, entitled Deck Installation Track, filed on Jan. 24, 2012, Applicant Mark A. Claudin, which is incorporated herein by reference.

COPYRIGHT

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates to construction. In particular, but not by way of limitation, the present invention relates to systems and methods for installing decking.

BACKGROUND OF THE INVENTION

Decking is a popular addition to many homes and businesses. Historically, decking has been installed by building a support beam foundation system topped by a joist system, and then attaching decking boards on top of the joist system. The decking boards are often made of composite materials. To attach the deck boards to the joist system, the most direct approach has been to nail or screw directly through from the top of the deck board through to the joist, as shown in FIG. 38C. Then, to conceal the screw and improve the aesthetic appeal and life of the deck, a plug may be used. An angled attachment, as shown in FIG. 38B has also been proposed. To provide for appropriate spacing between the deck boards, gapping tools, such as that shown in FIG. 38C may be installed and attached to the joist as well.

In other methods, a concealed gapping and fastening tool, such as that shown in FIG. 38A, has been developed. This concealed gapping and fastening tool is (generally forcibly) inserted into a side of the deck board, and then screwed into the joist using a 45 degree angle.

Although each of the above methods are functional, they are labor intensive and require a high degree of skill on the part of the deck installer, requiring, for example fairly precise locating skills on the part of the installer; that is, the installer must guess where the joist is located when installing according to FIG. 38C. In the alternative, the installer must be skilled enough to appropriately angle and attach the screw, as shown in FIGS. 38A-38B and/or use a costly aligning tool to achieve the appropriate angle. Finally, each of the devices in FIGS. 38A-38C are relatively small in size, leading to a high loss of material and/or material hunting on the part of the installer when the components fall to the ground below the deck. None of the previous approaches allow for a replacement of old decking boards without removing and replacing the attachment components.

Accordingly, a system and method are needed to address the shortfalls of present technology and to provide other new and innovative features.

SUMMARY OF THE INVENTION

Exemplary embodiments of the present invention that are shown in the drawings are summarized below. These and other embodiments are more fully described in the detailed description section. It is to be understood, however, that there is no intention to limit the invention to the forms described in this summary of the invention or in the detailed description. One skilled in the art can recognize that there are numerous modifications, equivalents and alternative constructions that fall within the spirit and scope of the invention as expressed in the claims.

The present invention can provide a device and method for installing decking. In one exemplary embodiment, the present invention can include a method of installing decking. The method includes aligning a track for decking relative to a joist. The method further includes attaching the track to the joist, and snapping a decking board into a retaining portion of the track after attaching.

In another exemplary embodiment, the present invention can include a device for installing decking. The device may be a track for decking, having a base element with a first end portion, a second end portion opposing the first end portion, and at least one attachment element for attaching the track to a joist. The track has a first snap-fit element coupled to the first end portion of the base element, and a second snap-fit element coupled to the second end portion of the base element. The first snap-fit element and the second snap-fit element are configured to retain at least one decking board.

As previously stated, the above-described embodiments and implementations are for illustration purposes only. Numerous other embodiments, implementations, and details of the invention are easily recognized by those of skill in the art from the following descriptions and claims.

BRIEF DESCRIPTION OF THE DRAWINGS

Various objects and advantages and a more complete understanding of the present invention are apparent and more readily appreciated by reference to the following detailed description and to the appended claims when taken in conjunction with the accompanying drawings wherein:

DETAILED DESCRIPTION

Figures 1, 5:
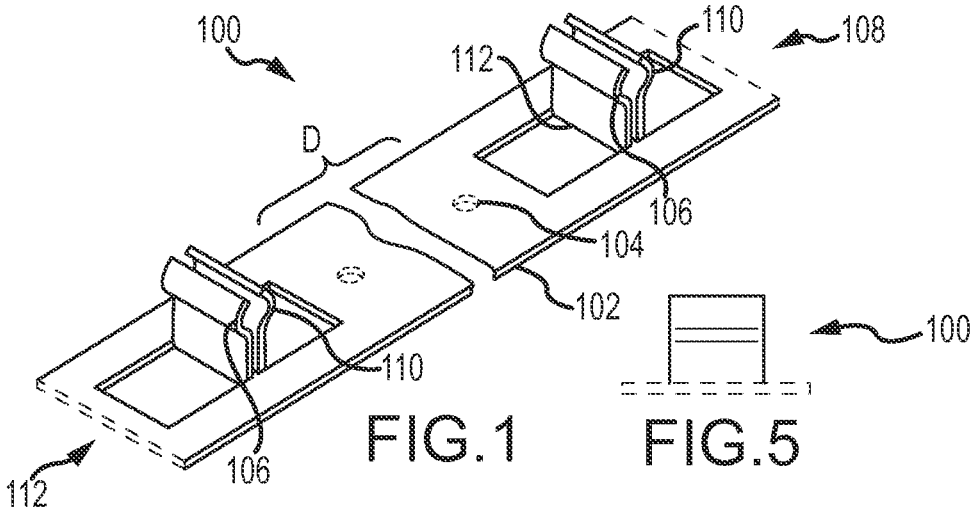
FIG. 1 is a perspective view of a track according to one embodiment.
FIG. 5 is a side view of the track in FIG. 1.
Figure 2:
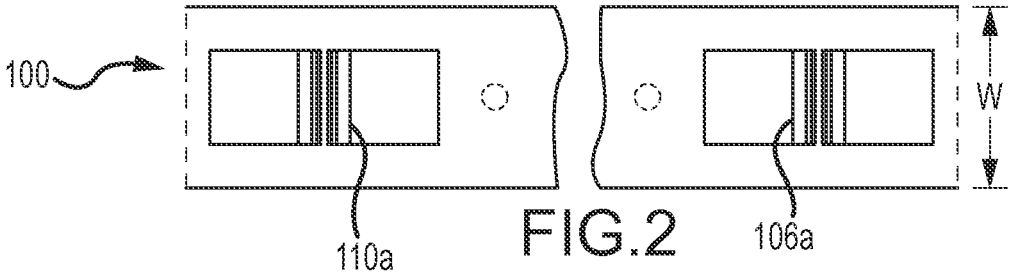
FIG. 2 is a top view of the track in FIG. 1.
Figure 3:
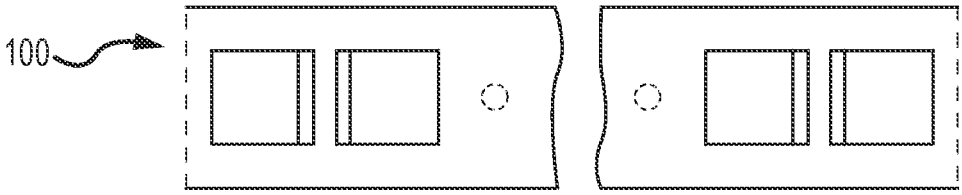
FIG. 3 is a bottom view of the track in FIG. 1.

Referring now to the drawings, where like or similar elements are designated with identical reference numerals throughout the several views, and referring in particular to FIGS. 1-5, shown is a deck installation track, or track 100, for short. The track 100 comprises a base element 102 having at least one attachment element 104, a first snap-fit element 106 attached to a first end portion 108 of the base element 102, and a second snap-fit element 110 attached to a second end portion 112 of the base element 102 create a retaining portion or retaining feature of the track 100. The track 100 may be manufactured of any material suitable for the expected function of installing and maintaining decking boards, such as the decking board 114 shown in FIG. 4, including, without limitation, steel, iron, composites, plastics, aluminum, and combinations thereof, treated to withstand typical temperature and other various weather fluctuations.

Figure 12:
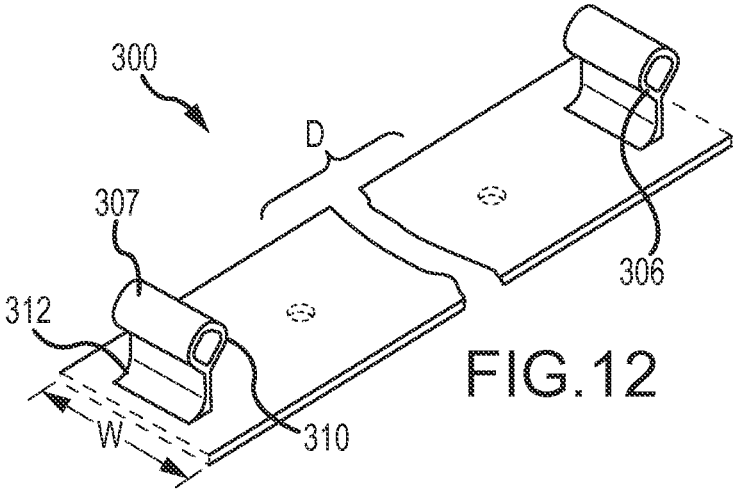
FIG. 12 is a perspective view of a track according to another embodiment.
Figure 13:
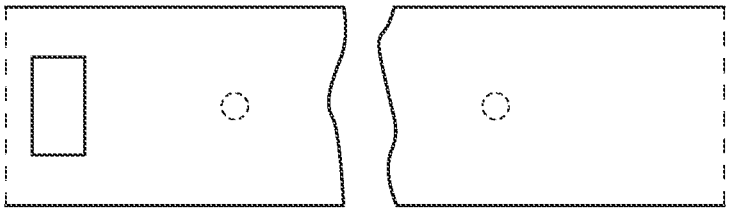
FIG. 13 is a top view of the track in FIG. 12.
Figure 14:
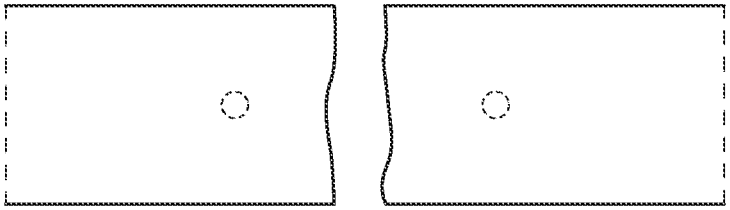
FIG. 14 is a bottom view of the track in FIG. 12.
Figure 15:
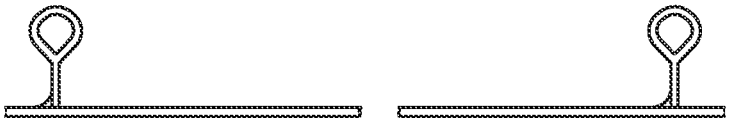
FIG. 15 is a front view of the track in FIG. 12.
Figure 16:
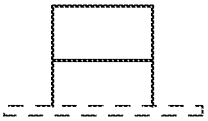
FIG. 16 is a right side view of the track in FIG. 12.
Figure 17:
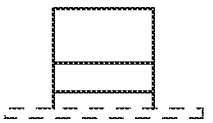
FIG. 17 is a left side view of the track in FIG. 12.
Figure 18:
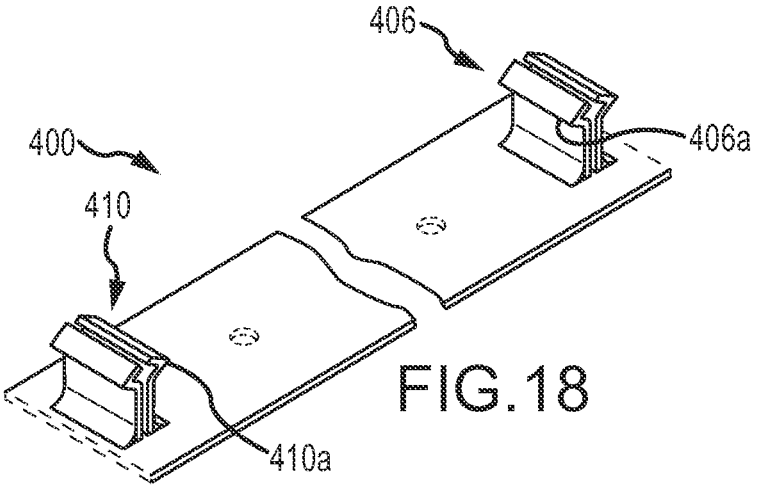
FIG. 18 is a perspective view of a track according to another embodiment.
Figure 19:
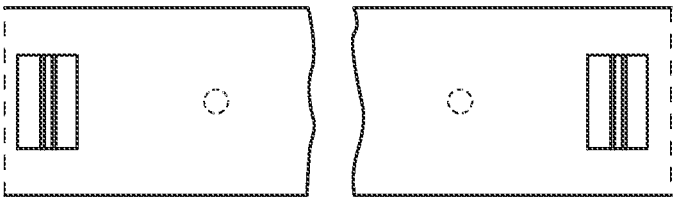
FIG. 19 is a top view of the track in FIG. 18.
Figure 20:
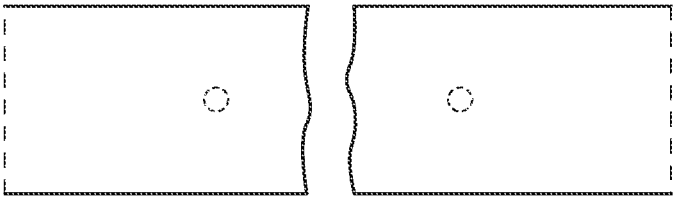
FIG. 20 is a bottom view of the track in FIG. 18.
Figure 21:
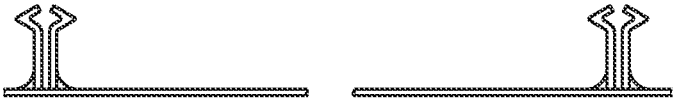
FIG. 21 is a front view of the track in FIG. 18.
Figure 22:
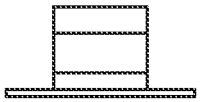
FIG. 22 is a side view of the track in FIG. 18.
Figure 23:
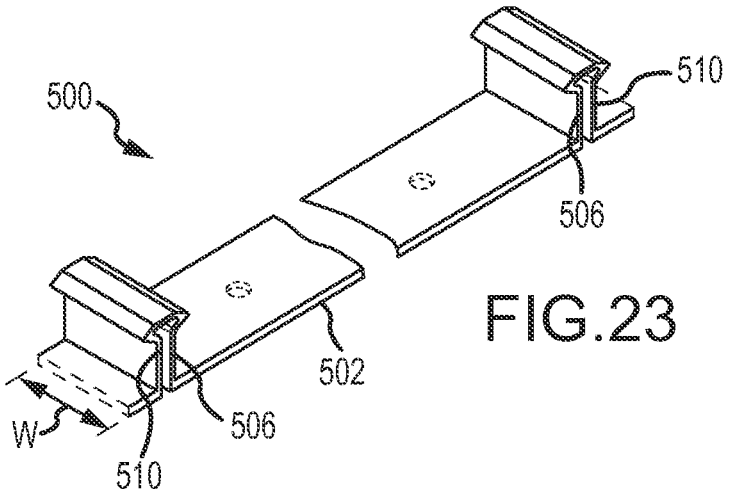
FIG. 23 is a perspective view of a track according to another embodiment.
Figure 24:
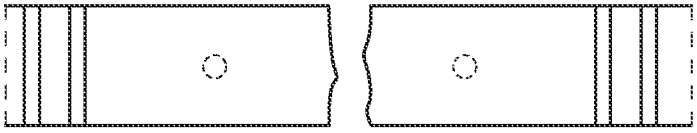
FIG. 24 is a top view of the track in FIG. 23.
Figure 25:
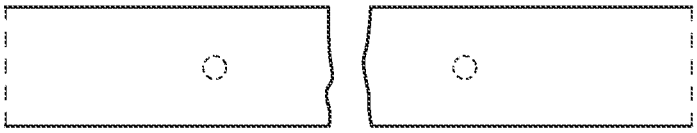
FIG. 25 is a bottom view of the track in FIG. 23.
Figure 26:
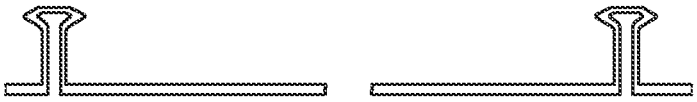
FIG. 26 is a front view of the track in FIG. 23.
Figure 27:
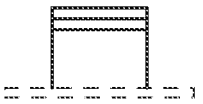
FIG. 27 is a side view of the track in FIG. 23.
Figure 28:
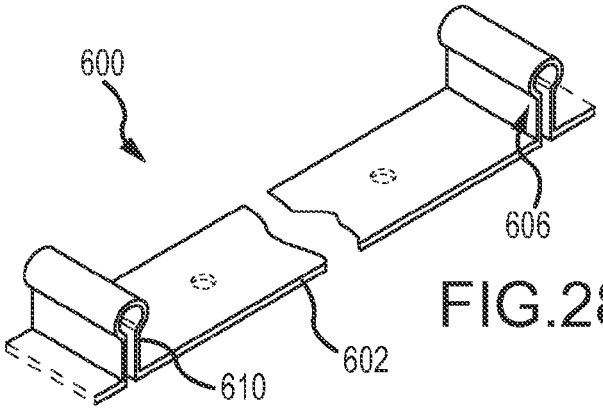
FIG. 28 is a perspective view of a track according to another embodiment.
Figure 29:
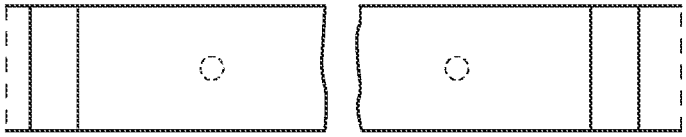
FIG. 29 is a top view of the track in FIG. 28.
Figure 30:
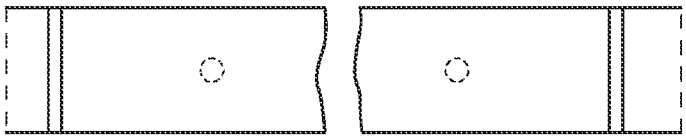
FIG. 30 is a bottom view of the track in FIG. 28.

As shown in FIGS. 1-5, the base element 102 includes at least one attachment element 104. The attachment element 104 may be one or more through-holes as shown, to allow a screw, nail, or other attachment device 116 to allow the track 100 to be screwed or nailed onto a joist of a decking base. Placement of the attachment element 104 may be such that, after a decking board 114 is installed, the decking board 114 may also be removed by pulling up without bending or otherwise destroying the base element 102. More specifically, as shown more clearly in FIG. 12, a distance D between two attachment elements 104 may be greater than between an attachment element 104 and an end portion 108, 112 to improve the removability of a track 100 without damaging the track 100.

Although a through-hole is shown, it should be understood by those skilled in the art that the attachment element 104 may comprise other means for attachment to a joist, such as, without limitation, a clip extending around the base element 102 and joist, and a slot for allowing a nail or screw to attach the base element 102 to the joist. It should also be understood that, even where a through-hole is used, it is not necessarily limited to a centered placement on the base element 102.

Continuing with FIGS. 1-5, the snap-fit elements 106, 110 are now discussed. As seen, the snap-fit elements 106, 110 are attached to the base element 102, and extend upwards to form a space between the snap-fit elements 106, 110 for receiving a decking board 114 therebetween. The snap-fit elements 106, 110 may each include an inward protrusion 106*a*, 110*a* configured to protrude into a recess 114*a* in the decking board 114, to provide a snap-fit between the track 100 and the decking board 114. The protrusions 106*a*, 110*a* may include a bend, as shown, a raised welded surface, or any other appropriate protrusion 106*a*, 110*a* suitable for retaining a decking board 114 in between the spacing formed by the first and second snap-fit elements 106, 110.

The first and/or second snap fit elements 106, 110 may be formed continuously with the base element 104 at a bend 112, as shown in FIGS. 1-5, for they may be attached by other means, such as gluing, screwing, bonding, casting, or welding. As one example, FIGS. 6-11, illustrate a track 200 having snap-fit elements welded on the base element 104 at weld seam 212.

Figure 4:
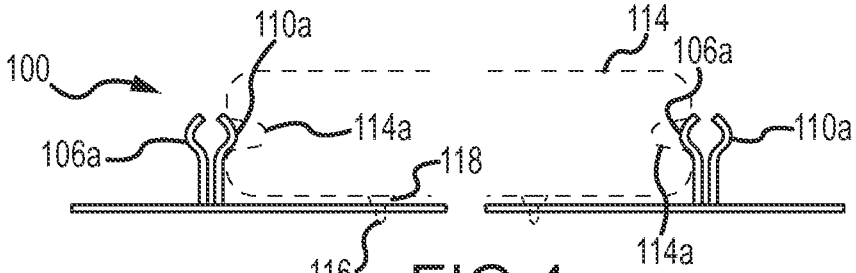
FIG. 4 is a front view of the track in FIG. 1 showing a relationship to a decking board.
Figure 6:
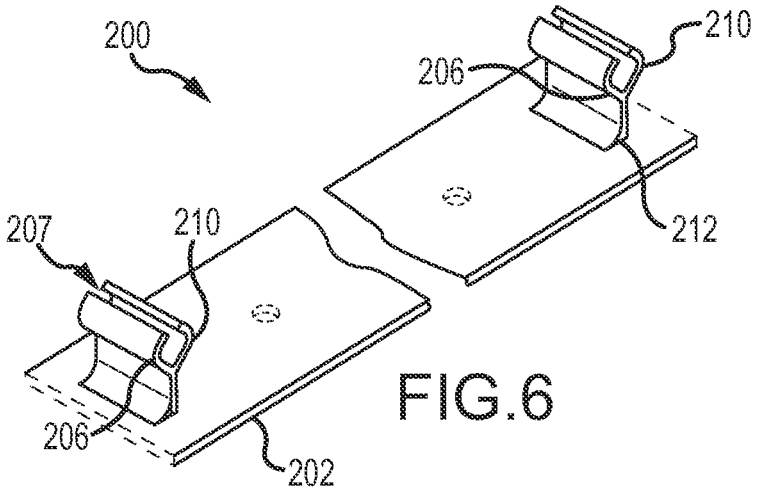
FIG. 6 is a perspective view of a track according to another embodiment.
Figure 7:
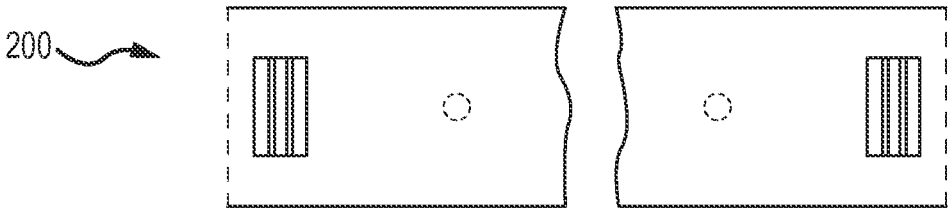
FIG. 7 is a top view of the track in FIG. 6.
Figure 8:
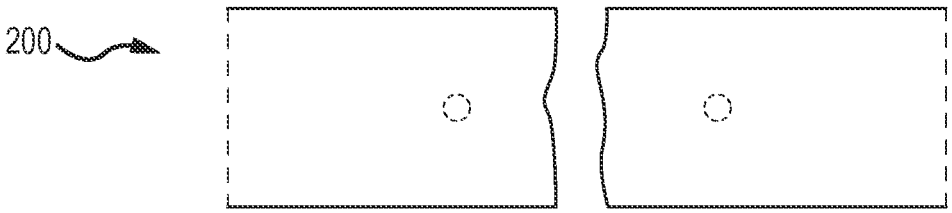
FIG. 8 is a bottom view of the track in FIG. 6.
Figure 9:
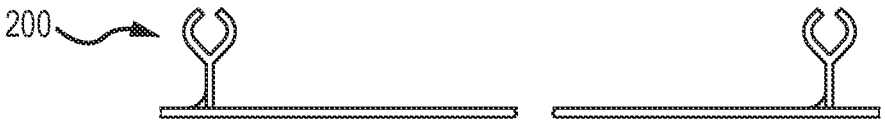
FIG. 9 is a front view of the track in FIG. 6 showing a relationship to a decking board.
Figure 10:
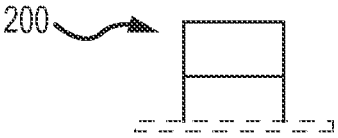
FIG. 10 is a right side view of the track in FIG. 6.
Figure 11:
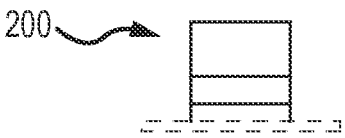
FIG. 11 is a left side view of the track in FIG. 6.
Figure 34:
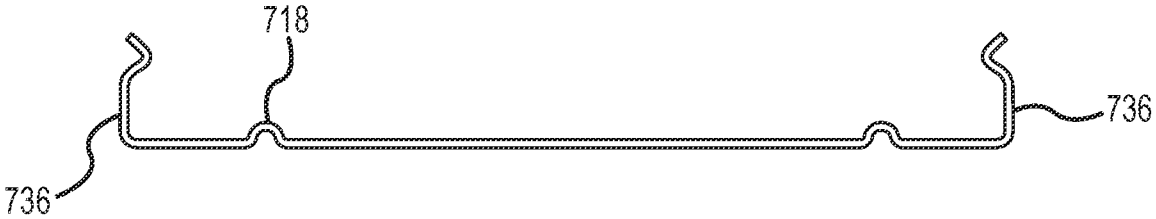
FIG. 34 is a front view of the track in FIG. 33.

Turning now to FIGS. 4 and 34, an elevating element 118, 718 is now discussed. As seen, after installation of the track 100 and the decking board 114, the decking board 114 may be maintained slightly above the attachment element 104, so as to protect the life of the decking board 114 by ensuring water is not pulled about the underside of the decking board 114. In FIG. 4 the elevating element 118 is the head of a screw or nail. In FIG. 34, the elevating element 718 is a bend in the base element 702. It is noted that the elevating element 718 shown in FIG. 34 provides a secondary advantage in that the bend provides a strengthening effect to the base element 702.

Returning now to FIGS. 1-5, it should be understood that the spacing between the first and the second snap-fit elements 106, 110 may be configured to have a distance D to fit a variety of standard or non-standard decking boards 114. Likewise, the snap-fit elements 106, 110 may be configured to fit a variety of standard or non-standard decking boards 114.

Figure 35:
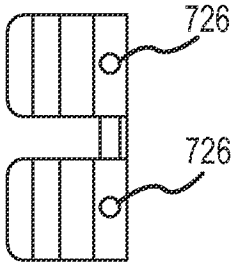
FIG. 35 is a side view of the track in FIG. 33.
Figure 33:
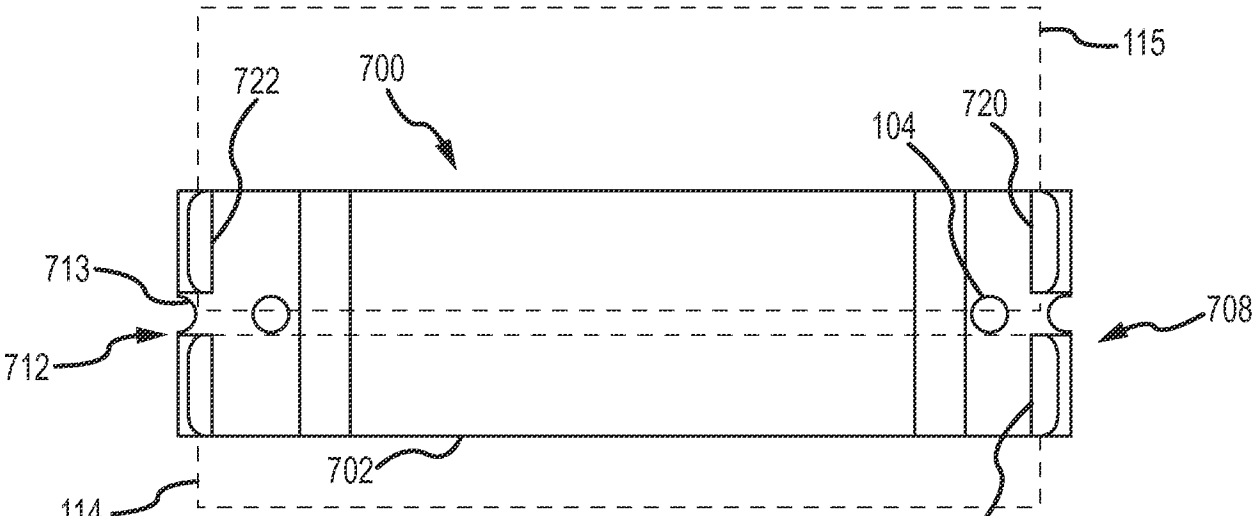
FIG. 33 is a top view of a track according to another embodiment.

It should also be understood that the first and second end portions 108, 112 of the track 100 may be repeated, as shown in FIGS. 1-32, such as with a continuous track having multiple sub-tracks 100, or the first and second end portions 708, 712 may end into bends to form the snap-fit elements, as shown in FIGS. 33-35. It should also be understood that the first snap-fit element 106 and the second snap-fit element 110 may repeat in a pattern forming a sub-track having a plurality of central snap-fit elements to allow for the installation of a plurality of decking boards 114, as most clearly shown in FIGS. 1, 4, and 31A.

Further, although shown in FIGS. 1-22 as having snap-fit elements 106, 110 that do not extend across the entire width W of the base element 102, it should be understood that, as shown in FIGS. 23-36, illustrating alternative embodiments of the track 500, 600, 700, 800, the snap-fit elements 806, 810 may extend across the entire width W of the base element 802.

Turning now to FIGS. 6-11, another embodiment of the track 200 is shown. As previously discussed, the snap-fit elements 206, 210 may be welded onto the base element 202 using a welded joint 212. It is also shown in FIGS. 6-11 that the first and the second snap-fit elements 206, 210 may be unitary with one another, forming protrusions on opposing sides, so as to enable a repeating pattern to be formed across the length of the base element 202. This repeating pattern may be used to install a plurality of decking boards 114 next to each other while maintaining a desired spacing between each of the decking boards 114.

The unitary snap-fit elements 206, 210 may have an open top 207 to allow for independent expansion/contraction of the associated decking board 114, or, as in the track 300 shown in FIGS. 12-17, the unitary snap-fit elements 306, 310 may have a closed top 307 to strengthen a retaining hold on the associated decking board 114.

Turning now to the track 400 shown in FIGS. 18-22, the snap-fit elements 406, 410 may be configured to fit a variety of decking boards using protrusions 406*a*, 410*a* that include sharp corners, as shown. The sharp corners may also provide a strong and/or permanent retaining force on the decking board 114. That is, the sharp corners may in some embodiments provide for a deck and track 400 that is not removable.

Figure 36:
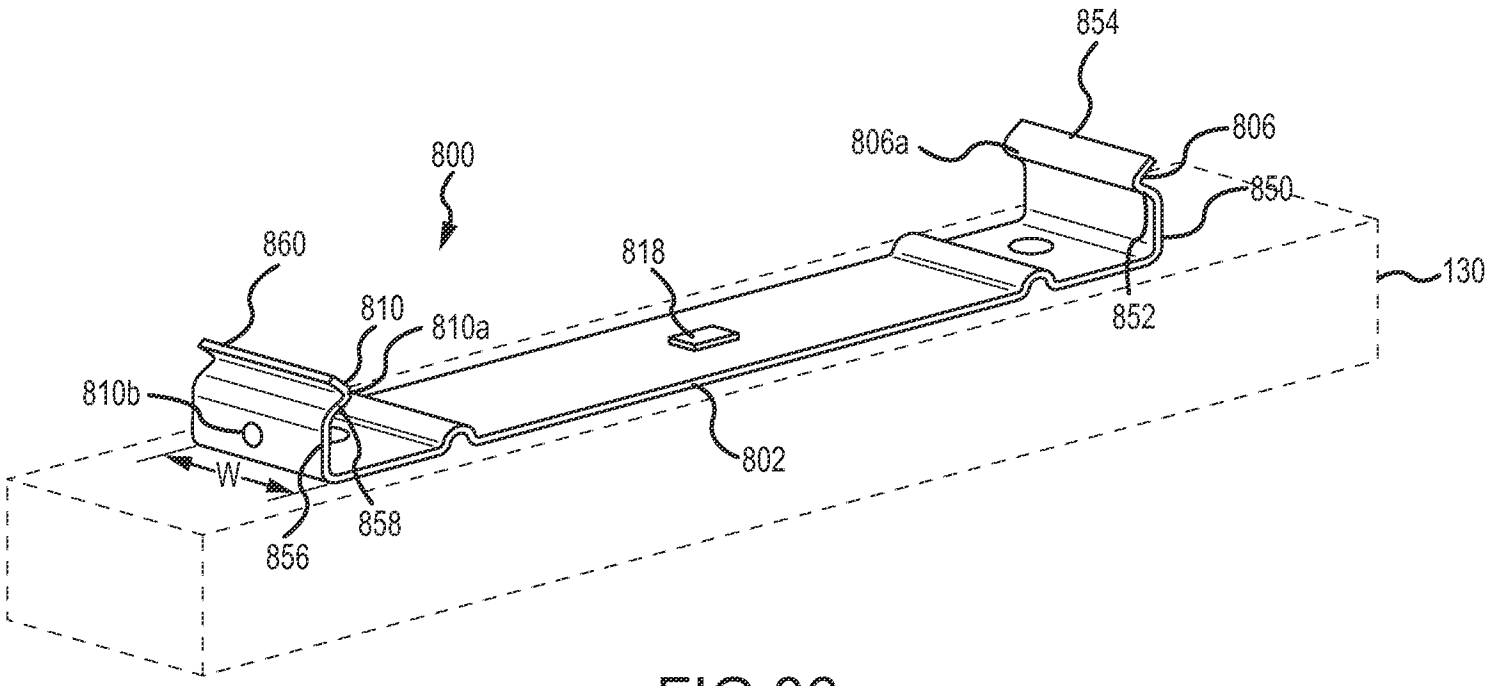
FIG. 36 is a perspective view of a track according to another embodiment.

Turning now to the track 500 shown in FIGS. 23-27, the first snap-fit element 506 of a first sub-track may be attached to the second snap-fit element 510 of a second sub-track to form a track 500 having a repeated pattern. The first snap-fit element 506 and the second snap-fit element 510 may be formed using a continuous piece of material, as shown in FIGS. 23-32. Similarly, the first snap-fit element 506 and/or the second snap-fit element 510 may be formed along with the base element 502 from a continuous piece of material. As an alternative, the snap-fit elements may be independently formed and later welded, perhaps using spot welds 706*b*, 810*b* between an outer wall of a first snap-fit element and an outer wall of a second snap-fit element as shown in FIGS. 35-36.

Figure 31:
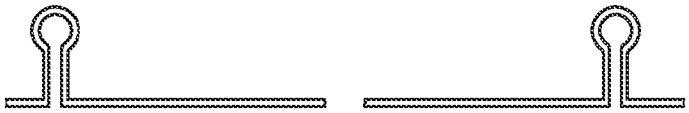
FIGS. 31 and 31A are front views of the track in FIG. 28.
Figure 31A:
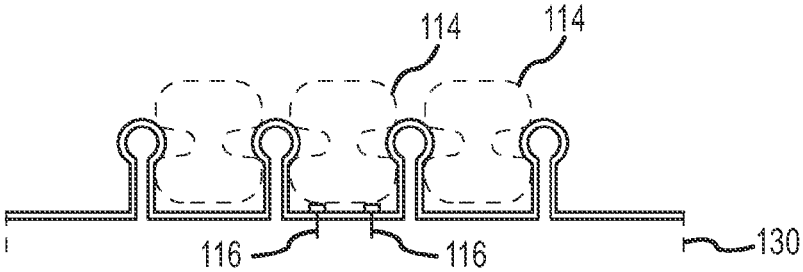
Figure 32:
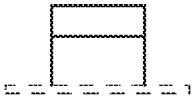
FIG. 32 is a side view of the track in FIG. 28.

As seen in FIGS. 28-32, the snap-fit elements 606, 610 of the track 600 may include inwardly curved portions while also being formed continuously with the base element 602 to form a repeating pattern. In FIG. 31A, the relationship between the track 600 and a joist 130 is shown. As seen, the track 600 is installed lengthwise along the joist 130 using a plurality of attachment devices 116 or screws, thereby covering a substantial portion of the top of the joist 130 and protecting the top of the joist 130 from weathering. After the track 600 is installed, a plurality of decking boards 114 are snapped into the spaces between the snap-fit elements 606, 610, as shown.

Turning now to FIGS. 33-35, another embodiment is now discussed. In the track 700 shown in FIGS. 33-35, one or more of the end portions 708, 712 of the track may have two snap-fit elements attached. That is, the track 700 may have a first and a second snap-fit element 706, 710 configured to retain an end portion of a first decking board 114, as well as a third snap-fit element 720 and a fourth snap-fit element 722 configured to retain an end portion of a second decking board 115, as shown in FIG. 33. It should be understood that, although the first, second, third, and fourth snap-fit elements 706, 710, 720, 722 are configured to retain two decking boards 114, 115, the four snap-fit elements may retain just one decking board 114 at a mid-portion of the decking board 114.

As previously described, the track 700 may include an elevating element 718 to maintain the decking board 114, 115 elevated above the base element 702. The elevating element 718 may include a bend in the base element 702, the head of a screw or nail 118, or any other raised portion, such as, without limitation, a raised welded spot or seam. The welded seam 212, 312 seen in FIGS. 6-17 may be used to elevate the decking board along with the previously-described role of attaching the snap-fit elements, as just one example. In the alternative, a raised welded spot 818 or ridge may be applied anywhere along the base element 802, as shown in FIG. 36.

As illustrated in FIG. 36, in some embodiments, the track 800 may have a first snap-fit element 806 that has a first flange 852 extending substantially upwardly from the base 802, a second flange 852 extending inwardly and upwardly from the first flange 852, and a third flange 854 extending outwardly and upwardly from the second flange 852. Similarly, the second snap-fit element 810 may have a fourth flange 856 extending substantially upwardly from the base 802, a fifth flange 858 extending inwardly and upwardly from the fourth flange 856, and a sixth flange 860 extending outwardly and upwardly from the fifth flange 858. As further illustrated in FIG. 36, the second flange 852 and third flange 854 may form a first inward protrusion 806*a* in the first snap-fit element 806, while the fifth flange 858 and sixth flange 860 may form a second inward protrusion 810*a* in the second snap-fit element 810.

Figure 37:
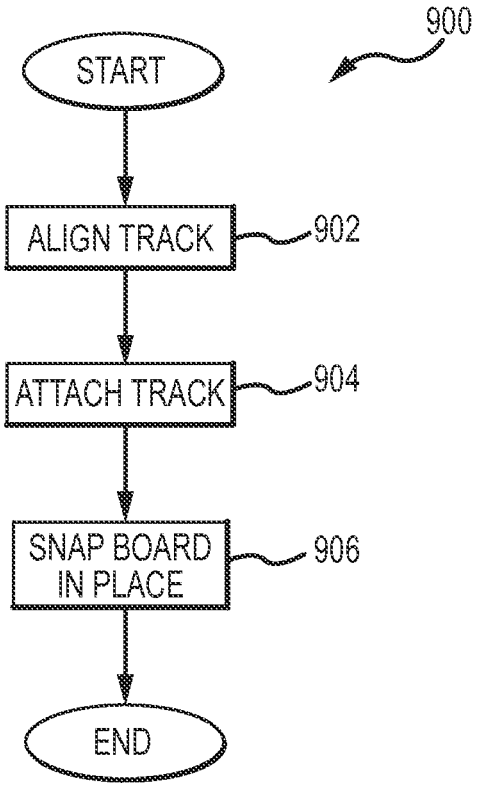
FIG. 37 is a flow diagram of a method according to an embodiment.
Figure 38A:
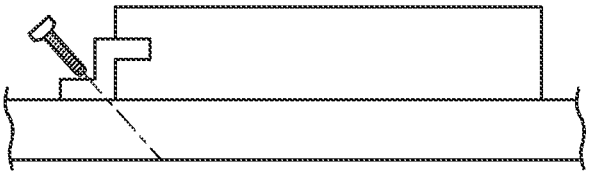
FIGS. 38A-38C are front views illustrating the relationship between various prior art tracks and decking boards.
Figure 38B:
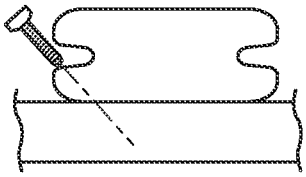
Figure 38C:
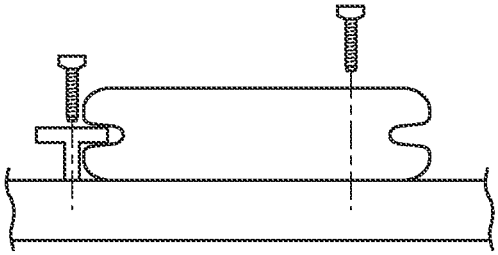
FIG.38C Prior Art

Turning now to FIG. 37, a method 900 of installing decking is now described. The method 900 includes aligning a deck installation track 902, attaching the track 904, and snapping a decking board 906 into a retaining portion of the track.

Aligning 902 includes aligning a track according to at least one of the tracks 100, 200, 300, 400, 500, 600, 700, 800 previously described in this disclosure such that the track runs along a joist 130, as shown in FIG. 31A or FIG. 36, for example. That is, an elongated portion of a base element in the track is aligned with an elongated portion of the joist. In some embodiments, such as where the track comprises a repeated pattern of snap-fit elements, the method 900 may include aligning 902 such that the base element protects a substantial portion of the top of the joist from weather. More specifically, the track may extend along a significant portion of the joist, and aligning 902 the track over the joist may provide weather protection to the joist.

Attaching 904 includes using one or more attachment devices 116 and attachment elements 104, which may be similar to the attachment devices and elements 116, 104 previously described, to temporarily or semi-permanently affix the track to the joist. In some embodiments, attaching 904 may include using a screw to attach the track, and setting the screw into the joist at approximately a ninety degree angle relative to a top of the joist, while maintaining a direct line of site between the installer and the attachment element, such as attachment element 104, while attaching the track.

Snapping 906 includes using a decking board 114 to apply enough downward pressure to cause the snap-fit elements of the track to deform, providing enough space between the snap-fit elements for the decking board to move down into the space between the snap-fit elements. Snapping 906 also includes releasing the decking board 114, and allowing inward protrusions of the snap-fit elements to partially fill a recess in a side of the decking board 114, as shown in FIG. 4, and permanently or semi-permanently retaining the decking board in position. In some embodiments, the method 900 may include snapping an end portion of the decking board into a spacing between a first snap-fit element and a second snap-fit element, or the method 900 may include snapping a central portion of the decking board into a spacing between the first snap-fit element and the second snap-fit element. In some embodiments, snapping may include overcoming a resistance of a material having a hardened material, such as hardened steel, to press a decking board into position. In some embodiments, snapping may include overcoming a resistance of a material having a Rockwell hardness of greater than 64 to press a decking board into position.

In some embodiments, the method 900 may include maintaining the decking board elevated relative to the attachment element using an elevating element.

The method 900 may include snapping a plurality of decking boards into position after attaching the track.

The method 900 may include using a plurality of snap-fit elements to maintain a consistent spacing between each of a plurality of decking boards.

The method 900 may include attaching a plurality of tracks, each comprising a plurality of snap-fit elements and a plurality of attachment elements.

The method 900 may include snapping an end portion of a first decking board into a spacing between the first snap-fit element and the second snap-fit element; and snapping an end portion of a second decking board into a spacing between a third snap-fit element at the first end portion of the base element and a fourth snap-fit element at the second end portion of the base element.

The method 900 may include causing the first decking board to fluctuate in size longitudinally and transversely; causing the second decking board to fluctuate in size longitudinally and transversely and independent of the first decking board; maintaining a snap-fit to the first decking board; and maintaining a snap-fit to the second decking board independent of the first decking board.

In conclusion, embodiments of the present invention provide, among other things, a device and method for installing decking. Those skilled in the art can readily recognize that numerous variations and substitutions may be made in the invention, its use and its configuration to achieve substantially the same results as achieved by the embodiments described herein. Likewise, a variety of combinations of the elements shown in the numerous embodiments may be made. Accordingly, there is no intention to limit the invention to the disclosed exemplary forms. Many variations, modifications and alternative constructions fall within the scope and spirit of the disclosed invention as expressed in the claims.

What is claimed is:

1. A method of installing and removing decking; comprising:

aligning a track for decking relative to a joist;

attaching the track to the joist; and snapping a decking board into a retaining portion of the track after attaching, wherein snapping comprises pressing the decking board downward and causing a snap-fit element in the track to be displaced as the decking board is moved downward, the snap-fit element being unitary with a base of the track, the snap-fit element having a first flange extending upwardly from a base of the track, a second flange extending inwardly and upwardly from the first flange, and a third flange extending outwardly and upwardly from the second flange, the second flange and the third flange forming an inward protrusion;

allowing the inward protrusion in the snap-fit element to engage a recess in a side of the decking board, wherein the second flange abuts a lower portion of the recess and the third flange abuts an upper portion of the recess in the side of the decking board to removably retain the decking board;

pulling the decking board upwardly away from the track; and allowing the inward protrusion in the snap-fit element to elastically displace as the decking board is moved upward to remove the decking board from the track.

2. The method of claim 1, wherein the track comprises a base element, the base element comprising at least one attachment element for attaching the track to a joist; a first snap-fit element coupled to a first end portion of the base element; and a second snap-fit element coupled to a second end portion of the base element; wherein the first snap-fit element and the second snap-fit element are configured to retain at least one decking board; the method comprising:

maintaining a direct line of site of the at least one attachment element while attaching the track.

3. The method of claim 1, wherein snapping the decking board comprises one of:

snapping an end portion of the decking board into a spacing between a first snap-fit element and a second snap-fit element; and snapping a central portion of the decking board into a spacing between a first snap-fit element and a second snap-fit element.

4. The method of claim 1, comprising:

using a base element to protect a substantial portion of the top of the joist from weather.

5. The method of claim 1, comprising:

maintaining the decking board elevated relative to an attachment element using an elevating element.

6. The method of claim 1, comprising:

attaching a track comprising a plurality of snap-fit elements and a plurality of attachment elements; and after attaching the track, snapping a plurality of decking boards into a plurality of retaining portions of the track.

7. The method of claim 6, comprising:

using the plurality of snap-fit elements to maintain a consistent spacing between each of the plurality of decking boards.

8. The method of claim 6, comprising:

attaching a plurality of tracks to one or more joists, each track comprising a plurality of snap-fit elements and a plurality of attachment elements.

9. The method of claim 6 comprising:

snapping an end portion of a first decking board into a spacing between a first snap-fit element and a second snap-fit element; and snapping an end portion of a second decking board into a spacing between a third snap-fit element at the first end portion of the base element and a fourth snap-fit element at the second end portion of the base element.

10. The method of claim 9, comprising:

maintaining a snap-fit to the first decking board while accommodating a longitudinal and transverse fluctuation in size of the first decking board; and maintaining a snap-fit to the second decking board independent of the first decking board while accommodating a longitudinal and transverse fluctuation in size of the second decking board.

* * * * *